US006893175B2

(12) United States Patent
Sussmeier et al.

(10) Patent No.: US 6,893,175 B2
(45) Date of Patent: May 17, 2005

(54) METHOD AND SYSTEM FOR HIGH SPEED DIGITAL METERING

(75) Inventors: John W. Sussmeier, Cold Spring, NY (US); Richard F. Stengl, Wolcott, CT (US); Jerry Leitz, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 42 days.

(21) Appl. No.: 10/675,403

(22) Filed: Sep. 30, 2003

(65) Prior Publication Data

US 2005/0069367 A1 Mar. 31, 2005

(51) Int. Cl.[7] ..... B41J 13/08

(52) U.S. Cl. ..... 400/608.4; 400/605; 400/607; 271/270; 271/3.18; 271/3.21; 271/347; 271/104

(58) Field of Search ..... 400/605–609; 271/270, 111, 3.14, 3.18, 3.21; 347/104, 215

(56) References Cited

U.S. PATENT DOCUMENTS 4,935,078 A * 6/1990 Bergman et al. ..... 156/64
6,301,522 B1 * 10/2001 Salazar et al. ..... 700/213
6,499,020 B1 * 12/2002 Dolan et al. ..... 705/406
6,644,660 B2 * 11/2003 Sussmeier et al. ..... 271/270
2004/0021755 A1 * 2/2004 Sussmeier ..... 347/104

FOREIGN PATENT DOCUMENTS

JP 02270740 * 11/1990 ..... B65H/5/06
JP 10006583 * 1/1998 ..... B41J/11/42

* cited by examiner

*Primary Examiner*—Ren Yan
*Assistant Examiner*—Marissa Ferguson
(74) *Attorney, Agent, or Firm*—Michael J. Cummings; Charles R. Malandra, Jr.; Angelo N. Chaclas

(57) ABSTRACT

A system and a method to control the motion of envelopes within a postage printing module to accommodate the use of slower print techniques and to achieve continuous high speed throughput in a mail processing system. At least two print heads in series are utilized to ensure continuous printing operation, even when a print head must be taken out of service for maintenance, or fails. Depending on which print head is in used, different sets of transport elements in the print module are used to affectuate the motion profile appropriate for the print head that is in operation. Based on the status of the print heads, a controller selectively groups different individual transport elements together to act in unison for the motion control. Print heads may be geared to operate in synchronism with the motion of the print transport.

20 Claims, 3 Drawing Sheets

METHOD AND SYSTEM FOR HIGH SPEED DIGITAL METERING

TECHNICAL FIELD

The present invention relates to a module for printing postage value, or other information, on an envelope in a high speed mail processing and inserting system. Within the postage printing module, the motion of the envelope is controlled to allow continuous high speed envelope throughput, even if the postage printing device operates at a lower velocity than other parts of the system.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Current mail processing machines are often required to process up to 18,000 pieces of mail an hour. Such a high processing speed may require envelopes in an output subsystem to have a velocity in a range of 80–85 inches per second (ips) for processing. Consecutive envelopes will nominally be separated by a 200 ms time interval for proper processing while traveling through the inserter output subsystem. At such a high rate of speed, system modules, such as those for sealing envelopes and putting postage on envelopes, have very little time in which to perform their functions. If adequate control of spacing between envelopes is not maintained, the modules may not have time to perform their functions, envelopes may overlap, and jams and other errors may occur. In particular, postage meters are time sensitive components of a mail processing system. Meters must print a clear postal indicia on the appropriate part of the envelope to meet postal regulations. The meter must also have the time necessary to perform the necessary bookkeeping and calculations to ensure the appropriate funds are being stored and printed.

A typical postage meter used with a conventional high speed mail processing system has a mechanical print head that imprints postage indicia on envelopes being processed. Such conventional postage metering technology is available on Pitney Bowes R150 and R156 mailing machines using model 6500 meters. The mechanical print head is typically comprised of a rotary drum that impresses an ink image on envelopes traveling underneath. Using mechanical print head technology, throughput speed for meters is limited by considerations such as the meter's ability to calculate postage and update postage meter registers, and the speed at which ink can be applied to the envelopes. In most cases, solutions using mechanical print head technology have been found adequate for providing the desired throughput of approximately five envelopes per second.

However, use of existing mechanical print technology with high speed mail processing machines presents some challenges. First, some older mailing machines were not designed to operate at such high speeds for prolonged periods of time. Accordingly, solutions that allow printing to occur at lower speeds may be desirable in terms of enhancing long term mailing machine reliability.

Another problem is that many existing mechanical print head machines are configured such that once an envelope is in the mailing machine, it is committed to be printed and translated to a downstream module, regardless of downstream conditions. As a result, if there is a paper jam downstream, the existing mailing machine component could cause even more collateral damage to envelopes within the mailing machine. At such high rates, jams and resultant damage may be more severe than at lower speeds. Accordingly, improved control and lowered printing speed, while maintaining high throughput rate in a mechanical print head mailing machine could provide additional advantages.

Controlling throughput through the metering portion of a mail producing system is also a significant concern when using non-mechanical print heads. Many current mailing machines use digital printing technology to print postal indicia on envelopes. One form of digital printing that is commonly used for postage metering is thermal inkjet technology. Thermal inkjet technology has been found to be an effective method for generating images at 300 dpi on material translating up to 50 inches per second (ips) and 200 dpi at 80 ips. Thus, while thermal inkjet technology is recognized as useful, it is difficult to apply to high speed mail production systems that operate on mail pieces that are typically traveling in the range of up to 100 ips in such systems.

As postage meters using digital print technology become more prevalent in the marketplace, it is important to find suitable substitutes for the mechanical print technology meters that have traditionally been used in high speed mail production systems. This need for substitution is particularly important as it is expected that postal regulations will require phasing out of older mechanical print technology meters, and replacement with more sophisticated meters. Ink jet digital print technology is now capable of printing a desired 200 dpi resolution on paper traveling at 80 ips., but has not yet been incorporated in the metering portions of high speed mail production systems.

It is known that many standard ink jet print heads must be stopped occasionally in order to perform maintenance routines. In particular, "drop-on-demand" style ink jet print heads are known to require periodic maintenance. Maintenance may include a "print head wipe" that occurs approximately every 500 prints, and has a duration of approximately 3 seconds. Maintenance also may include a "print head purge" that occurs after approximately every 3000 prints, and has a duration of approximately 14 seconds. For an inserter operating at 18,000 pieces per hour, the wipe and purge activities would occur every 100 seconds and ten minutes respectively. These maintenance activities result in reduced throughput performance. For example, an inserter that would otherwise operate at 18,000 piece per hour, would be reduced to 17,000 pieces per hour as a result of purge and wipe print head maintenance.

More expensive ink jet technology is available that does not require such frequent maintenance. For example, Scitex™ ink jet printers can run continuously, will no significant interruption. However, such continuous printers can be prohibitively expensive, and it is preferred that less expensive drop-on-demand ink jet print head technology can be used.

Some systems that have been available from Pitney Bowes for a number of years address some issues relating to using a slower speed meter with a higher speed mail production system. These systems utilize mechanical print head R150 and R156 mailing machines using 6500 model postage meters installed on an inserter system. The postage meters operate at a slower velocity than that of upstream and downstream modules in the system. When an envelope reaches the postage meter module, a routine is initiated within the postage meter. Once the envelope is committed within the postage meter unit, this routine is carried out without regard to conditions outside the postage meter. The routine decelerates the envelope to a printing velocity. Then, the mechanical print head of the postage meters imprints an indicia on the envelope. After the indicia is printed, the envelope is accelerated back to close to the system velocity, and the envelope is transported out of the meter.

Using the R150 or R156 mailing machines in this manner postage can be printed on envelopes at a lower print velocity. However, problems still occur for systems operating at higher velocities, such as 80 ips. At this higher speed, the time interval between consecutive envelopes is so short that the R150 and R156 machines cannot reset itself in time to print an indicia on a second envelope. To solve this problem, Pitney Bowes has offered a solution for number of years utilizing two mailing machines arranged serially in the envelope transport path. A diagram of this prior art system is depicted in FIG. 1.

In this serial mailing machine solution, envelopes are transported along transport path 100. When a first of a series envelopes reaches the first serial mechanical mailing machine 101, the first envelope is decelerated for a printing operation by postage meter 104. After printing is complete, the first envelope is carried away from the first serial machine 101 via transport 102 to the second serial mechanical mailing machine 103.

At the second mailing machine 103, the first envelope is typically decelerated to the print velocity. However, since an indicia has already been printed on the first envelope, no printing operation is performed by the second postage meter 105. The first envelope is then accelerated back to the system velocity and carried out of the serial postage printing arrangement.

The motion control of deceleration and acceleration at the second postage meter 105 without performing a print operation is done in order to maintain the displacements of consecutive envelopes in the system. Failure to subject subsequent envelopes to the same displacements may result in one envelope catching up to the other and causing a jam.

Following the first envelope, a second envelope arrives at the first mailing machine 101. The second envelope is subjected to the deceleration and acceleration motion profile. In a high speed system, however, the first postage meter 104 may not have had time to reset to print another indicia. Accordingly, the second envelope passes through the first mailing machine 101 without a printing operation. The second envelope is then passed via transport 102 to the second mailing machine 103 where it is again decelerated to the print velocity. This time, mailing machine 103 does perform a printing operation and an indicia is printed on the second envelope by postage meter 105. Mailing machine 103 then accelerates the envelope back to the system velocity, and the second envelope is carried away downstream.

In this manner, some of the shortcomings of conventional mailing machines are avoided by allowing the serial mailing machines 101 and 103 to alternately take turns printing indicia on every-other envelope. One disadvantage of this serial arrangement is that it remains very sensitive to gaps sizes between consecutive envelopes. Gaps between subsequent envelopes are shortened every time a lead envelope undergoes the printing motion profile. If an error occurs in the processing to make the gap size smaller than expected, envelopes can catch-up to one another, and a paper jam can result. Also, the R150 and R156 mailing machines are a bit too long to have time to carry out printing motion profile before the arrival of the next envelope, and to still have some margin for error in the arrival of a subsequent envelope. As a result, envelopes can be passed off between sets of nips that are not going at the same speed, creating potential for pulling or buckling. Accordingly, a solution with better space utilization and that is less sensitive to gap size variation is desirable.

Another problem with existing solution is that the conventional postage meters are inflexible in adjusting to conditions present in upstream or downstream meters. For example, if the downstream module is halted as a result of a jam, the postage meter will continue to operate on whatever envelope is within its control. This often results in an additional jam, and collateral damage, as the postage meter attempts to output the envelope to a stopped downstream module.

SUMMARY OF THE INVENTION

The present application describes a system and a method to control the motion of envelopes within a postage printing module to accommodate the use of slower print techniques (digital or mechanical) in attempting to achieve continuous high throughput in a mail processing system. A motion control scheme is used in the printing module to decelerate a mail piece for slower speed printing, and then returning the mail piece back to the higher system transport speed after printing.

The invention is further directed to making effective use of a printing system that utilizes two print heads. Typically, only one print head is in use at a given time. But when one print head is taken out of service, whether for maintenance or because of a failure, continuous printing can be maintained by switching printing duties to the other one. However, different positions of the print heads may require that different portions of the print module transport act to effectuate the necessary print transport motion profile. Thus, when an upstream print head is in use, an upstream portion of the print module transport may be required to undergo the motion profile to account for the lower print speed. Likewise, when a downstream print head is in use, a downstream portion of the print module transport may be required for the motion profile.

Accordingly, a system using the present invention transports a first envelope at a nominal transport velocity to the postage printing module. The postage printing module receives the envelope at the nominal transport velocity. Based on predetermined criteria, one or the other of the at least two print heads is selected for printing the indicia on the envelope. If one print head is unavailable because of a failure, or because of a periodic maintenance sequence, then the other one is used. When the envelope has passed completely into the control of the postage printing module it is decelerated to a predetermined lower print velocity for printing an image of a predetermined length. After the printing is complete the envelope is accelerated back to the transport speed and transported to a downstream module. None of the intervals of deceleration, low print velocity, or acceleration may occur while an envelope in the postage printing module is also in the control of another module.

This motion control is carried out by different transport elements in the print module depending on which print head is being used. Transport elements, such as rollers, are grouped together to act in unison in order to effectuate the motion control at the appropriate location in relation to the print head. Depending on which print head is used, a particular transport element may or may not be in the group performing the motion control. Some transport elements may be in more than one grouping.

Deceleration in the motion control profile is activated by a sensor sensing the presence of the envelope at a trigger point. Further sensors at the upstream and downstream modules can be used to verify that no envelopes are under the shared control of the postage printing module and another module.

In another preferred embodiment, the print head is geared to operate in synchronism with the print transport, such that an image will not be distorted if there is a variation in print velocity.

The preferred system and method also provide a way to ensure that correct displacement is maintained between subsequent envelopes under the control of the invention in the event of a stop and/or restart of the system resulting from an exception condition, such as an envelope jam. When an envelope is within the print transport during an exception condition, the envelope must be decelerated to a stop, so as not to create further jams or collateral damage. In most modules in the system, a linear uniform deceleration is preferred to minimize disruption of the desired spacing between mail pieces being processed.

For the postage printing module, however, optimal performance using the present invention may require that deceleration not occur in the same uniform linear fashion as the rest of the system. Rather, deceleration is preferably controlled to maintain the relative displacement of envelopes in the postage printing module with respect to upstream and downstream modules. Because displacement varies in that module during normal operation, a uniform stopping and starting of the print module to mirror other modules will result in envelope spacing different than originally intended. Such changing in envelope gaps may result in further jams or misprocessing.

For this reason, the deceleration and acceleration resulting from the exception condition is controlled to maintain relative displacements as those displacements would have been if the exception condition had not occurred. To achieve this result, a controller in the print module controls the displacement of the print module according to a predetermined algorithm. This algorithm relates displacements of the print module with other modules for segments of the motion profile as they would have been executed during normal operation. During the exception condition, deceleration and acceleration of the print module is thus controlled as a predetermined function, or set of functions, of the displacements in other transport modules. The appropriate function is determined as a result of the position of the envelope in the print module during the course of the exception condition.

This displacement mapping functionality of the preferred embodiment operates cooperatively with the gearing of the print head mechanism to the print transport. In that preferred embodiment, stopping and restarting of the print module may not affect printing of an image on the envelope, even if a printing operation had already begun at the time of the stoppage.

The principles discussed herein are also applicable to a system condition in which the system is stopped without the occurrence of any problems. For example, this embodiment may be applied in a situation where an operator simply wishes to turn off the system in order to take a lunch break, without waiting for the job to finish. Using this embodiment, the process of routine stopping and starting of the system is simplified, and the risk of errors occurring from such stopping and starting is reduced. It will be understood that these features. Stoppage conditions include errors and exception conditions, as well as routine starting and stopping.

Further details of the present invention are provided in the accompanying drawings, detailed description and claims.

DETAILED DESCRIPTION

For the preferred embodiment of the present invention, it is desired that envelope printing throughput of 22,000 mail pieces per hour be achieved. To accomplish this goal, the transport velocity of the inserter system is typically 100 ips or greater. However, the preferred ink jet printing device to be used for printing a postage indicia is only capable of achieving a desired resolution of 200 dpi at a speed of 80 ips. Accordingly, the present invention will be described primarily in regard to a system whereby the print module 1 is used to decelerate envelopes from 100 ips, to 80 ips for printing, and back to 100 ips for further processing.

One feature of the present invention relates to reducing the speed of mail pieces to enable of ink jet printing at less than the system transport velocity.

Another feature, relating the use of a series of in line ink jet print heads, is further described in a co-pending application filed concurrently with this application, filed Sep. 30, 2003, entitled METHOD AND APPARATUS FOR CONTINUOUS HIGH SPEED DIGITAL METERING USING MULTIPLE PRINT HEADS, by John Miller, John Sussmeier, and Anthony Yap, application No. 10/675,362, which is hereby incorporated by reference in its entirety.

Figure 1:
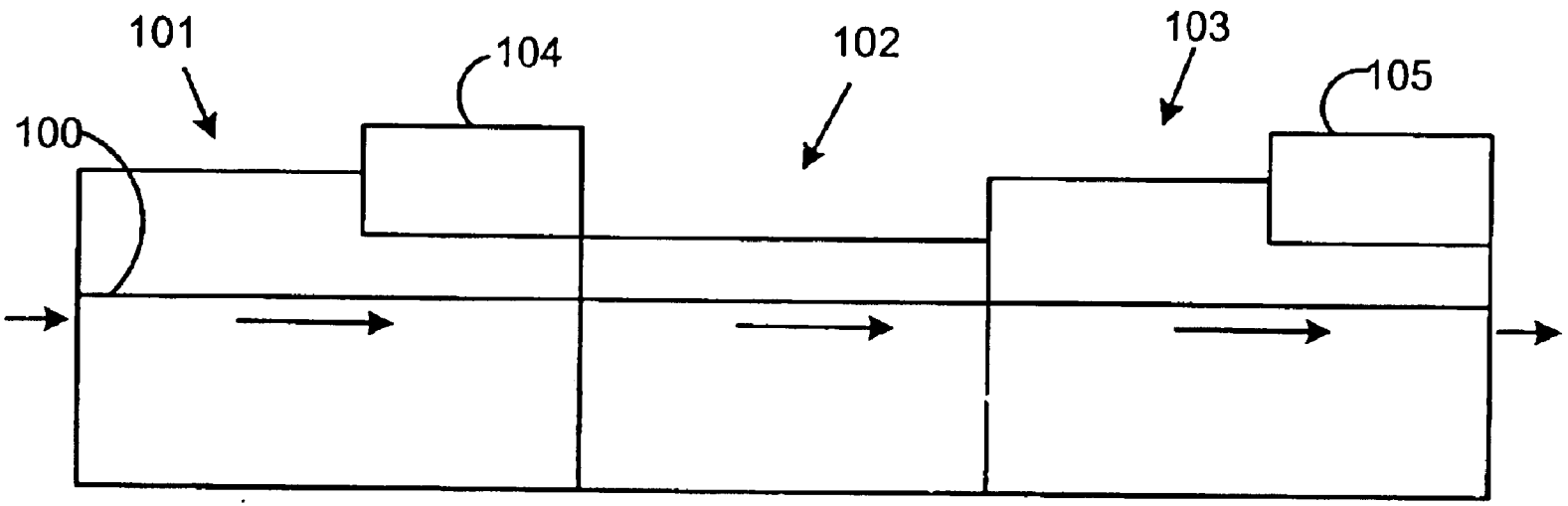
FIG. 1 ( PRIOR ART)
FIG. 1 depicts a prior art inserter metering system using two mechanical meters in series.
Figure 2:
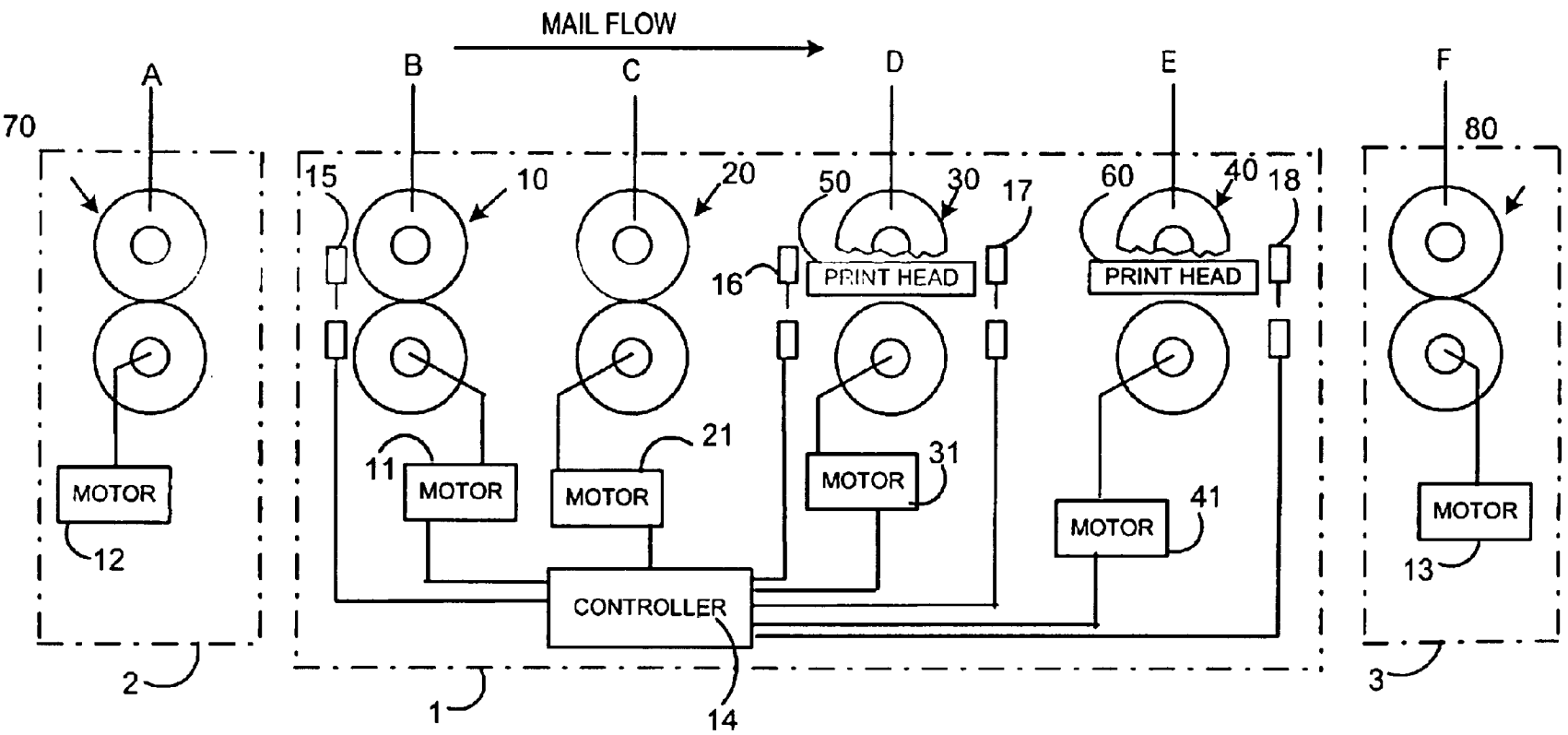
FIG. 2 is a diagrammatic view of a postage printing module in relation to upstream and downstream modules.

As seen in FIG. 2, the present invention includes a postage printing module 1 positioned between an upstream module 2 and a downstream module 3. Upstream and downstream modules 2 and 3 can be any kinds of modules in an inserter output subsystem. Typically the upstream module 2 could include a device for wetting and sealing an envelope flap. Downstream module 3 could be a module for sorting envelopes into appropriate output bins.

Postage printing module 1, upstream module 2, and downstream module 3, all include transport mechanisms for moving envelopes along the processing flow path. In the depicted embodiment, the modules use sets of upper and lower rollers 10, 20, 30, 40, 70, and 80 called nips, between which envelopes are driven in the flow direction. In the preferred embodiment rollers 10, 20, 30, 40, 70, and 80 are hard-nip rollers to minimize dither.

Print heads 50 and 60 are preferably located at or near the output end of the print transport portion of the postage printing module 1 (see locations D and E). To satisfy desired readability the print heads 50 and 60 should be capable of printing an indicia at a resolution of 200 dots per inch (dpi). In the preferred embodiment, the print heads 50 and 60 are drop-on-demand ink jet print heads capable of printing 200 dpi on media traveling at 80 ips. Alternatively, the print heads 50 and 60 can be any type of print heads, including those using other digital or mechanical technology, which may benefit from printing at a rate less than the system velocity.

In the preferred embodiment only one of print heads 50 or 60 is in use at a given time. Typically, one of the print heads, for example 50, will be used to print indicia on the stream of envelopes. Using the present invention, when it is time for print head 50 to undergo a maintenance cycle, rather than stop printing of indicia, print head 60 is brought into service to do the same job. Thus, only one print head operates at a time, with one print head operating as a back-up, and going into service when the primary undergoes a maintenance routine, or otherwise becomes unavailable. Adjustments to the transport system of print module 1 in support using the two print heads 50 and 60 in this manner are discussed below.

The rollers 10, 20, 30, and 40 for postage printing module 1 are driven by motors 11, 21, 31, and 41. For modules 2 and 3, rollers 70 and 80 are driven by electric motors 12 and 13 respectively. Motors 11, 21, 31, 41, 12, and 13 are preferably independently controllable servo motors. Motors 12 and 13 in upstream and downstream modules 2 and 3 drive rollers 70 and 80 at a constant velocity, preferably at the desired nominal velocity for envelopes traveling in the system. Thus in the preferred embodiment, upstream and downstream modules 2 and 3 will transport envelopes at 100 ips in the flow direction.

Motors 11, 21, 31, and 41 drive rollers 10, 20, 30, and 40 in the postage printing module 1 at varying speeds in order to provide lower velocity printing capabilities. Postage printing module motors 11, 21, 31, and 41 are controlled by controller 14 which in turn receives sensor signals. Signals may be provided to the controller 14 from upstream sensor 15, downstream sensor 18, and trigger sensors 16 and 17. Sensors 15 and 18 are preferably used to detect the trailing edges of consecutive envelopes passing through the postage printing module 1, and to verify that the printing motion control adjustment only occurs while a single envelope under the control of the set of rollers performing the velocity change. Trigger sensor 16 determines that an envelope to be printed with an indicia is in the appropriate position to trigger the beginning of the print motion control scheme for print head 50, as described further below. Similarly trigger sensor 17 may be used for triggering the motion control scheme for print head 60.

Sensors 15, 16, 17 and 18 are preferably photo sensors that are capable of detecting leading and trailing edges of envelopes. While four photo sensors are depicted in the embodiment of FIG. 2, the system can be operated with as few as one photo sensor at an upstream location. The upstream single photo sensor would generate a signal upon deteting the presence of a lead or trail edge of an envelope. Subsequent to sensing the envelope, encoder pulses from the servo motors (11, 21, 31, 41) transporting the envelope could be counted, and the corresponding displacement can be accurately determined. Thus the controller 14 could trigger an action based on the sensing of an envelope edge, and then counting a predetermined quantity of pulses from the motor encoders. The preferred positioning of the sensors, and the utilization of signals received from the sensors are discussed in more detail below.

Referring to FIG.2, the location of the output of the transport for upstream module 2 is location A. The location for the input to the print transport of postage printing module 1 is location B. An intermediary transport roller 20 is located at point C. Transports 30 and 40 for print heads 50 and 60 are located at points D and E. Point E is also the output of the print transport mechanism for postage printing module 1. The input for the transport of downstream module 3 is location F.

The modules may also include other rollers, or other types of transports, at other locations. To maintain control over envelopes traveling through the system, consecutive distances between rollers 10, 20, 30, and 40 must be less than the shortest length envelope expected to be conveyed. In the preferred embodiment, it is expected that envelopes with a minimum length of 6.5" will be conveyed. Accordingly and the rollers 10, 20, 30, and 40 will preferably be spaced not more than 6.25" apart, so that an envelope can be handed off between sets of rollers without giving up control transporting the envelope at any time. The preferred embodiment is also designed to handle an envelope 10.375 inches long.

Upstream sensor 15 is preferably located at or near location B, while downstream sensor 16 is preferably located at or near location E. Trigger sensors 17 and 18 are preferably located upstream from print heads 50 and 60 by a sufficient distance to permit deceleration of the print transport from the nominal transport velocity to the print velocity upon the detection of a lead envelope edge. The trigger sensors 17 and 18 may be located any distance upstream from the minimum deceleration point, even as far upstream as upstream sensor 15, so long as the motion control profile determined by controller 14 is adjusted accordingly.

Controller 14 controls the motors 11, 21, 31, and 41 in accordance with a print motion control profile in order to achieve the goals of (1) reducing the speed of an envelope so that the lower velocity print heads 50 and 60 can print an indicia, (2) controlling the motion of the envelopes so that consecutive envelopes do not interfere with each other, and (3) allowing the printing duties to be shared between print heads 50 and 60 located at different positions along the transport path. The preferred motion control profile further allows that multiple envelopes may be handled within the print module 1 at a given time, and not interfere with one another, even when they are at different velocities, and without creating mismatches between print module 1 and the upstream and downstream modules 2 and 3.

Figure 3:
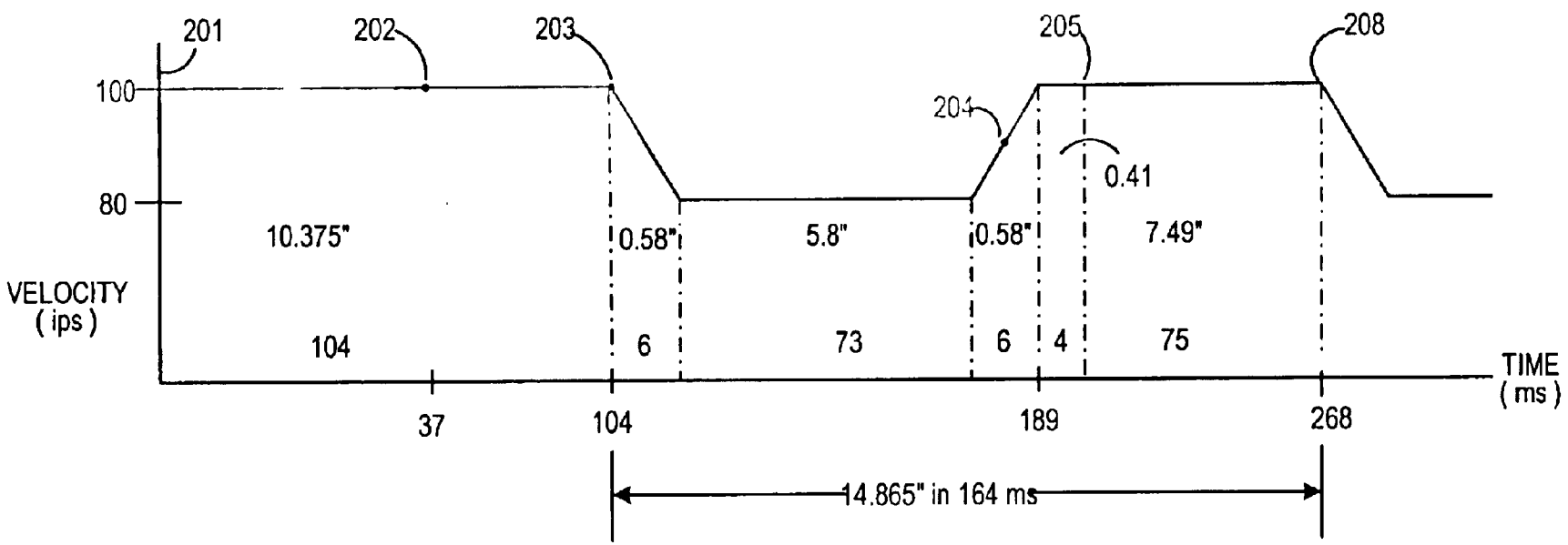
FIG. 3 is a graphical representation of a print motion control profile for controlling the speed of envelopes in the postage printing module.

Depending on which of the print heads 50 or 60 is in use, different groupings of transport rollers (10, 20, 30, 40) in print module 1 will be used to perform the print motion control profile to decelerate envelopes to the print velocity and to return them to the transport velocity. A preferred embodiment of a print motion control profile for use with the present invention is depicted in FIG. 3, and described further below.

Because print heads 50 and 60 are located at different locations along the transport path, the present invention enables the speed adjustment motion profile to begin and end at different locations in the print module 1. Thus, when print head 50 is in use, transport rollers 10, 20, and 30 will be used to perform the speed adjustment, while roller 40 will remain at the constant transport velocity.

When print head 60 is in use, roller 10 operates at constant velocity, as if it were part of the upstream module 2. Meanwhile, rollers 20, 30, and 40 are grouped together to perform the motion profile.

As a further enhancement to the performance of the present invention, the groupings of the rollers will only remain in place so long as the rollers are needed as part of the group. Upstream members of the groups will return immediately to the transport velocity as soon as an envelope being printed passes from its control. For example, if print head 50 is in use, rollers 10, 20, and 30 will operate in unison as the envelope comes under the control of the group. However, the envelope may pass out of the control of roller 10, even while the printing operation, and corresponding transport motion control, are being carried out. When this happens, roller 10 leaves the uniformly controlled group and immediate accelerates back to transport velocity. Similarly, roller 20 would return immediately to the transport velocity when the envelope leaves its control. In this manner, the upstream rollers are more quickly ready to receive envelopes from upstream sources, even as print speed adjustments are still underway.

In a preferred method of controlling the velocity adjustment groups is to designate master and slave roller nips. When print head 50 is in use, roller 30 (and motor 31) become a master for slave rollers 10 and 20 when an envelope comes under the complete control of the group. When the envelopes leave rollers 10 and 20, they cease to be slaved to roller 30 and may be slaved to the roller 70 for upstream module 2. For this example, roller 40 was never part of the velocity adjustment grouping, and may be slaved to roller 80 of downstream module 3.

When print head 60 is in use, the master roller for the velocity adjustment control group is roller 40. When an envelope enters the control of the control group, rollers 20 and 30 will be slaved to the master 40. In this situation, roller 10 may be continuously slaved to roller 70 of upstream module 2. As the envelope passes through the control group, and out of the control of rollers 20 and 30, they are preferably released from the master 40 and return to the transport velocity. In returning to the transport velocity, they may in turn be slaved to upstream roller 70.

Accordingly, controller 14 is programmed to designate the appropriate individually controllable rollers and motors as masters and slaves based on positions of envelopes sensed by the sensors. Concurrently, the controller 14 is also providing the appropriate motion profile for the control group to allow reduced velocity printing.

Initiation of the slaving of rollers and the print motion adjustment may be triggered by the controller when an envelope reaches a predetermined displacement downstream from sensor 15. The predetermined displacement is based on the distance between the trip photocell 15 and the print head 50, the deceleration rate, the indicia offset, upstream module velocity, print velocity, and settle time (before printing begins). For control purposes, the locations of the edges of envelopes may be detected based on the positioning of photocells at the exact locations. Alternatively, positions may be calculated by measuring encoder pulses from the servo motors, and adding the envelopes positional displacement from a known location of a previously tripped upstream sensor.

In the preferred embodiment depicted in FIG. 2, the following distances between components has been found to most effectively handle the expected range of envelope sizes:

A to B, 3.7 inches;

B to C, 3.9 inches;

C to D, 3.9 inches;

D to E, 6.25 inches; and

E to F, 6.1 inches.

FIG. 3 is an exemplary motion profile of master rollers 30 or 40 at locations D and E, depending on which of the print heads 50 or 60 is in use. Based on the criteria discussed above, rollers slaved to the master rollers will also perform portions of motion profile. Notations provide the translation distances of envelopes within the velocity adjustment control group of rollers for different intervals. The depicted profile is based on a system that is printing on envelopes 10.375" inches in length, that requires a maximum length printed indicia of 5". The nominal transport velocity is 100 ips, and the print velocity is 80 ips. The accelerations for adjusting speeds are 8.0 G's, or 3091 in/s$^2$. For this embodiment, the throughput rate is 22,000 mailpieces per hour. At the nominal transport speed the period between envelopes is 164 ms.

The print heads 50 and 60 are preferably located just downstream of nip roller sets 30 and 40. This location allows greater control at the print head location, and also minimizes the opportunity for errors relating to an envelope tail kick. Tail kick occurs when the trail edge of an envelope is not adequately constrained and comes into contact with a print head, thereby causing print head damage and failure.

At point 201 on the profile, a lead edge of a first envelope reaches the output of the upstream module 2, at location A. In this exemplary profile, there is no envelope to be printed in the cycle before the first envelope. After crossing between the gap between the module transports, at point 202 the lead edge of the first envelope is at the most upstream roller of the velocity adjustment control group (location B or C). At point 202 there can be no unilateral change in velocity of the print module transport by the control group. Sensors 15 and 16 can provide signals to controller 14 to prevent initiation of a change in velocity while an envelope is under the control of more than one module, or more than one control group.

At point 203 on the motion profile, the first envelope is under the sole control of the control group of roller for print module 1, and the control group may slow down to allow the slower velocity printing. Controller 14 can begin the necessary deceleration by sensing the lead edge of the first envelope with the trigger sensor 16, 17. Alternatively, the deceleration can begin as a result of upstream sensor 15 detecting the position of the tail end of the first envelope. Preferably, before printing begins, 10 ms of settle time is allowed (or 80 ips*0.010 s=0.8 inches) after the mail piece reaches he print velocity.

After point 203, the three nips of the control group of the print module 1 initiate a predetermined deceleration to reach the desired print velocity, in this case 80 ips. The control group master roller then operates at 80 ips to transport the envelope a predetermined distance while an indicia is printed on it. In this exemplary embodiment the print distance is five inches. After the predetermined print distance has been completed, the envelope is accelerated back to the transport speed. Slaved control group rollers upstream of the master roller, preferably return to the transport velocity of 100 ips prior to completion of the motion control profile of FIG. 3, once the envelope has passed out of their control.

After the motion control profile has been complete, such as at point 205, the lead edge of the first envelope reaches the first nip downstream of the master nip. At this point in time, the first envelope is no longer under the exclusive control of the control group and variations in the print transport speed are not permissible.

Using the motion profile depicted in FIG. 3, and the control scheme discussed previously, envelopes can be slowed for lower speed printing, but without having subsequent envelopes collide. The nominal distance between envelopes for the example described would be about 6.025 inches before entering the print module 1. After performing the print motion profile, the minimum distance between envelopes is reduced to 4.49 inches. However, the nominal distance is restored as the subsequent envelope has the same motion profile performed on it, and the prior envelope travels away at the nominal travel velocity of 100 ips. Accordingly, the throughput of the system remains intact.

The exemplary motion profile described above complies with requirements necessary for a successful reduced velocity print operation. As mentioned above, when print speed adjustment is performed on an envelope, the velocity adjustment control group of nip in print module 1 must have total control of the envelope. For example, the envelope cannot reside between nip rollers at location A or F during execution of the print motion control profile.

In a further preferred embodiment of the present invention, to ensure accurate printing, the rate at which the print heads 50 and 60 print the indicia can be electronically or mechanically geared to the speed of the print transport in the print module 1. In such case, under circumstances where the print transport is operating outside of nominal conditions, a correct size and resolution print image can be generated. In the electronic version of this preferred embodiment, controller 14, print head 50 or 60, and the master roller servomotor 31 or 41 are geared to the same velocity and timing signals to provide that the transport and printing are always in synchronism.

Another preferred embodiment of the present invention addresses a problem that occurs when the print module 1 is forced to deviate from the motion control profile depicted in FIG. 3. For example, in a conventional inserter system, when an envelope jam occurs downstream from the postage printing module, upstream and downstream modules typically come to a halt in accordance with a uniform rapid linear deceleration profile. Unfortunately, in conventional inserter systems, the postage.printing modules have no mechanism for halting envelopes that are committed within the postage meter. As a result, additional paper jams and damaged envelopes commonly occur as the postage printing module forces envelopes against a halted downstream module.

To address this problem, in the preferred embodiment of the present invention the print module 1 will also decelerate to a stop upon the occurrence of an exception event. Such exception events may include detection of jams, detection that mail pieces are out of order, or detection of equipment malfunctions. If the print head 50 or 60 is geared to the master motor 31 or 41, then an envelope can be stopped anywhere in the print module 1 upon the occurrence of an exception event without damaging the envelopes, and without compromising the image to be printed on the envelope. After the error condition has passed, print module 1 can be accelerated back to the velocities in accordance with the motion profile depicted in FIG. 3.

A uniform linear deceleration and acceleration during an exception condition is preferred for the upstream and downstream modules 2 and 3. However, a deceleration and acceleration having that same uniform linear profile may cause problems in print module 1. For example, if the print transport was about to reach point 203 in the motion profile of FIG. 3 when the exception condition occurred, the control group of the print transport could decelerate down to zero velocity in a linear fashion the same as modules 2 and 3. However, after the exception condition has been cleared, the envelope in the print module 1 will be closer to the downstream module than it would have been if the normal motion profile had been executed. This is because during the uniform deceleration, the print module 1 has essentially skipped a portion of the motion profile. During this "skipped" portion, it was intended that the envelope decelerate to the print velocity. A result of that deceleration would have been an increase in the gap with a downstream envelope and a decrease in a gap with an upstream envelope. A uniform shutdown profile for all modules interferes with this planned variation in gap sizes.

Accordingly, the present invention maintains the expected displacements between consecutive documents by controlling the transport of envelopes in print module 1 as a function of the displacement positions of upstream and/or downstream modules 2 and 3. Thus, the variations in velocity that result from the stoppage and starting in an exception condition should not affect the relative spacing of the envelopes. In the equations provided below for determining the appropriate displacement relationship, the velocity variables will be eliminated, and positions of the transports expressed in terms of variable displacements and known constants.

To achieve this desired result, the desired displacements of the print module 1, as they would have resulted from performance of the motion profile under nominal conditions, must be describable in terms of the position of upstream or downstream modules. Also, the descriptions must be expressed in terms of the displacement relationships that would have resulted from the distinct segments in the motion profile.

For example, for the portion of the motion profile where the print module 1 should transport the envelope at the transport velocity, there should be a one-to-one correspondence in the displacements produced by an upstream module 2 and print module 1. Thus, if an exception condition occurs while an envelope is at a location within the print module 1 where it would normally be traveling at the transport velocity, then the deceleration of the print module 1 during an exception condition will mirror that of the upstream module 2. For this exemplary situation, the equation relating the displacement position of the print module 1, "$P_1$," to the displacement position of the upstream module 2, "$P_2$," will be:

$$P_1=P_2. \quad [1]$$

If the envelope is located at a position where it would normally be subject to deceleration in preparation for a printing operation, then, during an exception condition, print module 1 must decelerate more quickly than upstream module 2 in order that the shortening of the gap between envelopes in those modules be preserved. To derive the appropriate displacement relationship for this segment of the print module 1 motion, the following symbols are defined:

v=velocity of the print module 1 transport;

$v_{transport}$=the transport velocity for the system, (nominally 100 ips);

$v_{print}$=the print velocity for print module 1 during the printing segment of the motion profile (nominally 80 ips);

$a_1$=acceleration that print module 1 would normally undergo in the deceleration segment of the motion profile (deceleration being a negative value acceleration) (nominally −1500 in/sec);

$a_2$=acceleration that print module 1 would normally undergo in the acceleration segment of the motion profile (nominally 1500 in/sec);

$P_{decel}$=the displacement that print module 1 normally undergoes during the deceleration portion of the motion profile (nominally 0.58 inches); and $P_{accel}$=the displacement that print module 1 normally undergoes during the acceleration portion of the motion profile (nominally 0.58 inches).

During normal operation in accordance with the motion profile, the displacement position, $P_1$, of the print module 1, starting at the beginning of the deceleration segment, is described according to the equation:

$$P_1=(v^2-v_{transport}^2)/2a_1 \quad [2]$$

An expression can also be derived relating the velocity, v, of print module 1 as a function of the displacement position, $P_2$, of upstream module 2, during normal operation of the deceleration portion of the motion profile:

$$v=((v_{print}-v_{transport})/P_{decel})P_2+v_{transport} \quad [3]$$

Thus, an equation relating $P_1$ and $P_2$, independent of instantaneous velocities, is derived by substituting the value of "v" derived in equation [3] into equation [2]. Performing this substitution, displacement relationship between print module 1 with upstream module 2, for the deceleration segment of the motion profile is:

$$P_1=((((v_{print}-v_{transport})/P_{decel})P_2+v_{transport})^2-v_{transport}^2)/2a_1 \quad [4]$$

Using this relationship in equation [4], controller 14 of print module 1 can adjust the displacement of print module 1 when an envelope is present at a location where it normally would undergo the deceleration portion of the motion profile.

The next segment of the motion profile for discussion is the printing portion. During that segment the envelope is transported at a constant velocity, $v_{print}$. Accordingly, for that segment, the relative displacements that would be seen in upstream module 2 and print module 1 would be described as a fixed ratio. This relationship is described by the following equation:

$$P_1=(v_{print}/v_{transport})P_2. \quad [5]$$

It should be noted that the appropriate displacement relationship may change while the print module 1 is decelerating to a stop. For example, an envelope that is slightly upstream of trigger sensor 16 or 17, and traveling at the transport velocity, may begin to stop in accordance with the displacement relationship described in equation [1], above. However, during the deceleration, but before stopping, the envelope may reach the trigger position marked sensor 16 or 17. After the trigger sensor 16 or 17 has been reached controller 14 will switch the displacement relationship to that described in equation [4] above. Thus, as many different displacement relationships may be utilized as may be necessitated by the positions reached by the envelope during the deceleration process. Thus, if the deceleration were protracted to reach a location where a printing segment was intended, then displacement may be controlled in accordance equation [5] above. Also, based on the gearing of the print head 50 or 60 with the motor 31 or 41, the print head may begin printing a portion of the image on the envelope before it stops. When the print module 1 restarts, the geared print head will also resume printing at the appropriate geared speed.

A final segment of the motion profile is the acceleration of the envelope from the print velocity, back to the transport velocity. The displacement mapping relationship for this segment can be derived in the same way as for equation [4] above. A difference in the result, being that this acceleration segment is causing an envelope in the print module 1 to increase its distance from a subsequent envelope in upstream module 2. Accordingly, the displacement relationship when an envelope is at the acceleration motion profile segment during a stopping or restarting condition is as follows:

$$P_1=((((v_{transport}-v_{print})/P_{accel})P_2+v_{print})^2-v_{print}^2)/2a_2 \quad [6]$$

Displacement information for respective print, upstream, and downstream modules 1, 2, and 3 may typically be monitored via encoders in motors 11, 21, 31, and 41. The encoders register the mechanical movement of the module transports and report the displacements to controller 14 for appropriate use by controller 14 to maintain correct displacement mapping between the modules.

In this application, a preferred embodiment of the system has been described in which documents being processed are envelopes. It should be understood that the present invention may be applicable for any kind of document on which printing is desired. Also a package or a parcel to which a printed image is applied as part of a processing system should also be considered to fall within the scope of the term "document" as used in this application.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A printing system for use in a high velocity document processing system using lower velocity print technology, the system comprising:

a transport path comprising an upstream transport conveying documents at a transport velocity, a downstream transport conveying documents at the transport velocity, a print transport located between the upstream transport and the downstream transport, the print transport driven independently of the upstream transport and the downstream transports and comprising a plurality of individually controllable rollers;

an upstream print head contiguous with the print transport to print on documents transported thereon;

a downstream print head, downstream of the upstream print head, and contiguous with the print transport to print on documents transported thereon;

a controller controlling a first one of the upstream or downstream print heads to print on transported documents, the controller further switching to a second of the upstream or downstream print heads when the first one is out of service, the controller further controlling a roller group of less than all of the plurality of individually controllable rollers according to a predetermined motion profile, whereby under nominal conditions the roller group decelerates the print transport to a nominal print velocity prior to a printing operation in a first segment, maintains the nominal print velocity during the printing operation in a second segment, and accelerates the print transport back to the transport velocity after completion of the printing operation in a third segment; and wherein the controller controls the roller group to comprise of an upstream portion of the plurality of individually controllable rollers if the upstream print head is in use, and to comprise a downstream portion of the plurality of individually controllable rollers if the downstream print head is in use.

2. The printing system of claim 1 wherein one or more of the individually controlled rollers that are not part of the roller group when a given print head is in use are operated at the transport velocity.

3. The printing system of claim 1 wherein the roller group controlled by the controller to decelerates to a stop upon the occurrence of a stoppage condition in the document processing system, the deceleration controlled by the controller in accordance with a predetermined algorithm to maintain a relative displacement of the roller group with respect to upstream or downstream transports to maintain the relative displacements that would have occurred under the predetermined motion profile under nominal conditions, the predetermined algorithm determining the displacement of the roller group as a function of displacement of upstream or downstream transports.

4. The printing system in accordance with claim 3 wherein the controller further controls the roller group to accelerate from a stop back to nominal condition upon the occurrence of a restart after the stoppage condition, the acceleration controlled by the controller in accordance with the predetermined algorithm to maintain the relative displacement of the roller group with respect to upstream or downstream transports to maintain the relative displacements that would have occurred under the predetermined motion profile under nominal conditions, the predetermined algorithm determining the displacement of the roller group as a function of displacement of upstream or downstream transports.

5. The printing system of claim 4 wherein the print heads are electronically or mechanically geared to the corresponding roller group so that variations in print transport velocity during a printing operation will not affect an image being printed.

6. The printing system of claim 4 wherein the predetermined algorithm for determining relative displacements includes a first function for accounting for changes in relative displacements that would have occurred during deceleration of the roller group in the first segment of the motion profile, a second function for accounting for changes in relative displacements that would have occurred during the reduced nominal print velocity of the second segment of the motion profile, and a third function for accounting for changes in relative displacements that would have occurred during acceleration of the print transport in the third segment of the motion profile, the appropriate of the first, second, and third functions being invoked by the controller based on the position of a document in the roller group during the occurrence of the stoppage condition.

7. The printing system of claim 1 further comprising:

a sensor arrangement comprising an upstream sensor determining a presence of a document within the print transport portion of the transport path and generating a sensor signal;

the controller receiving the signal from the sensor and initiating the predetermined motion profile responsive to the signal.

8. The printing system of claim 1 wherein the upstream portion and the downstream portion of the plurality of individually controllable rollers include at least one same roller and at least one different roller.

9. The printing system of claim 8 wherein the plurality of individually controllable rollers comprises four rollers, and the upstream portion for forming the roller group comprises the three most upstream rollers, and the downstream portion for forming the roller group comprises the three most downstream rollers.

10. The printing system of claim 1 wherein the controller further controls an arrangement of the roller group whereby a member of the roller group leaves the roller group after an envelope passes downstream from the member's control.

11. The printing system of claim 10 wherein the controller controls a velocity of the member that leaves the roller group after the envelope passes downstream from the member's control to be the transport velocity.

12. The printing system of claim 1 wherein the upstream and downstream print heads are comprised of drop-on-demand print heads.

13. A method for printing in a high velocity document processing system using lower velocity print technology, the method comprising:

transporting a document at a transport velocity in an upstream transport to a print transport;

transporting the document on the print transport;

transporting the document at the transport velocity in a downstream transport from the print transport;

printing an image on the document transported on the print transport using one of an upstream print head or a downstream print head, the downstream print head positioned downstream of the upstream print head;

selecting one of the upstream or downstream print heads for use in printing based which one of the print heads not being available due to print head maintenance;

while the document is within the print transport during nominal system conditions, controlling the velocity of the print transport in accordance with a motion profile, whereby the motion profile includes the steps of decelerating the document to a print velocity, maintaining the print velocity during the step of printing, and accelerating the document to the transport velocity after the step of printing is complete, the motion profile resulting in a relative displacement of the document with respect to upstream and downstream documents to vary during the motion profile;

periodically removing the upstream or downstream print head from use for print head maintenance; and performing the print transport motion profile with an upstream portion of the print transport when the upstream print head is in use, and with a downstream portion of the print transport when the downstream print head is in use, the upstream and downstream portions each comprising at least one different transport mechanism from the other.

14. The method of claim 13, wherein upon the occurrence of a stoppage condition while the document is within the print transport, further including the steps of:

modifying the motion profile by stopping the document within the print transport during a stoppage condition, decelerating the document to a stop, the step of decelerating to the stop including the step of maintaining the relative displacement of the document on the print transport with respect to upstream and downstream documents, the step of maintaining the relative displacement including controlling the deceleration according to a predetermined algorithm describing relative displacement between documents as such displacement would have occurred under the motion profile under nominal conditions, the predetermined algorithm determining the displacement of the print transport as a function of displacement of upstream or downstream transports.

15. The printing method in accordance with claim 14 further comprising the steps of:

restarting the print transport while the document is within the print transport during the stoppage condition, the step of restarting including the step of accelerating the document from the stop to a velocity of the motion profile, the step of accelerating including the step of maintaining the relative displacement of the document on the print transport with respect to upstream and downstream documents, the step of maintaining the relative displacement including controlling the acceleration according to the predetermined algorithm.

16. The printing method of claim 15 including the step of electronically or mechanically gearing the printing step to the print transport motion so that variations in print transport velocity during the printing step will not affect the image being printed.

17. The printing method claim 15 wherein the predetermined algorithm for determining relative displacements including a first function accounting for changes in relative displacements that would have occurred during deceleration of the print transport in the first segment of the motion profile, a second function accounting for changes in relative displacements that would have occurred during the reduced nominal print velocity of the second segment of the motion profile, and a third function accounting for changes in relative displacements that would have occurred during acceleration of the print transport in the third segment of the motion profile, and the method further including the step of invoking the appropriate of the first, second, and third functions based on the position of the document in the print transport during the occurrence of the stoppage condition.

18. The printing method of claim 13 wherein upstream and downstream portions of the print transport are comprised of a grouping of individually controllable rollers, the method further comprising:

controlling the grouping of rollers whereby a member of the grouping leaves the grouping after an envelope passes downstream from the members control, regardless of the motion profile.

19. The printing method of claim 18 further comprising controlling a velocity of the member that leaves the grouping to be the transport velocity.

20. The printing method of claim 13 further comprising using drop-on-demand ink jet printing for the upstream and downstream print heads.

* * * * *